US006648002B2

(12) United States Patent
Lappalainen

(10) Patent No.: US 6,648,002 B2
(45) Date of Patent: Nov. 18, 2003

(54) VACUUM SEWER SYSTEM

(75) Inventor: Vesa Lappalainen, Vantaa (FI)

(73) Assignee: Evac International Oy, Helsinki (FI)

( * ) Notice: Subject to any disclaimer, the term of this patent is extended or adjusted under 35 U.S.C. 154(b) by 5 days.

(21) Appl. No.: 10/105,552

(22) Filed: Mar. 25, 2002

(65) Prior Publication Data

US 2002/0189669 A1 Dec. 19, 2002

(30) Foreign Application Priority Data

Jun. 14, 2001 (FI) ..... 20011260

(51) Int. Cl.[7] ..... F04F 3/00
(52) U.S. Cl. ..... 137/205; 4/431
(58) Field of Search ..... 4/431; 137/205

(56) References Cited

U.S. PATENT DOCUMENTS 4,713,847 A * 12/1987 Oldfelt et al. ..... 137/202

5,165,457 A * 11/1992 Olin et al. ..... 137/202

* cited by examiner

*Primary Examiner*—Gerald A. Michalsky
(74) *Attorney, Agent, or Firm*—Marshall, Gerstein & Borun LLP

(57) ABSTRACT

A vacuum sewer system (1) comprises a source of sewage (2) and sewer piping (3) comprising a first sewer pipe (31) and a second sewer pipe (32). A first sewer valve (21) provided with an outlet port (22) is arranged between the source of sewage (2) and the first sewer pipe (31) and a second sewer valve (23) is arranged between the first sewer pipe (31) and the second sewer pipe (32), whereby the system comprises a vacuum generating means (36) for providing vacuum in the sewer piping (3). In order to minimize the noise level and the space requirement of the system the first sewer pipe (31) provides an intermediate receptacle for the sewage.

14 Claims, 2 Drawing Sheets

VACUUM SEWER SYSTEM

FIELD OF THE INVENTION

The present invention generally relates to vacuum sewer systems.

BACKGROUND OF THE INVENTION

Vacuum sewer systems are generally known in the art. One of the main problems with vacuum sewer systems is the noise resulting from the pressure differential providing the drainage or flushing function for the sewage and from the subsequent pressure equalization stage in the vacuum sewer system. In previous attempts to reduce the noise level, a two-phase function has been proposed. The two-phase system, however, increases the cost and space requirement for the system due to a larger number and size of additional components.

SUMMARY OF THE INVENTION

One object of the present invention is to avoid the above mentioned disadvantages and to achieve an efficient drainage function with a diminished noise level and by simple means.

Accordingly, standard components are utilized in order to reduce the space requirement for the system and to maintain sufficient economy. This is achieved by using the first sewer pipe, i.e. a so-called riser or branch pipe, conventionally connected directly to the discharge valve, i.e. the first sewer valve, of the source of sewage as an intermediate receptacle for the sewage during a first transport phase of the sewage.

A desired or sufficient volume, which is related to the so-called vacuum capacity of the intermediate receptacle, that is the first sewer pipe, can be provided by varying the length of the first sewer pipe.

In order to increase the drainage or flushing effect at a second transport phase of the sewage, a third valve means can advantageously be provided at the first sewer valve end of the first sewer pipe. Such a third valve means would be arranged as an aeration valve in order to deliver transportation air for the second transport phase.

By enlarging the pipe diameter directly after the outlet port of the first sewer valve, the noise level of the drainage or flushing function can be reduced. Such an enlarged diameter can advantageously be provided by a pipe section arranged downstream of the outlet port of the first sewer valve, advantageously a first pipe junction arranged between the outlet port of the first sewer valve and the first sewer pipe. The third valve means, i.e. the aeration valve, can advantageously be connected to the first pipe junction.

Another advantageous arrangement for providing a desired or sufficient volume for the intermediate receptacle is to provide the vacuum sewer system with a third sewer pipe at the first sewer valve end of the first sewer pipe. This arrangement provides for a further possibility to vary the volume of the intermediate receptacle, i.e. the vacuum capacity of the same.

The third valve means or the aeration valve can advantageously be arranged at the end of third sewer pipe opposite the first sewer valve end of the third sewer pipe.

As the first transport phase and the subsequent second transport phase of the sewage require a second sewer valve to be employed between the first sewer pipe and the second sewer pipe, the desired vacuum can advantageously be provided over the whole vacuum piping by a pressure equalization means, advantageously a connection pipe connecting said sewer pipes over said second sewer valve.

The system is advantageously provided with a control center for monitoring the function of the valves. One or more of the valves can be mechanically or electrically, or advantageously pneumatically operated. In the latter case the valve or valves are preferably vacuum activated valves using the vacuum prevailing in the vacuum piping and provided by the vacuum generating means for operating the valves.

The communication or connection between the prevailing vacuum and the valves through the control center is advantageously provided by tubing with interconnected solenoid valves for opening and closing the vacuum connections.

BRIEF DESCRIPTION OF THE DRAWINGS

In the following the invention will be described, by way of example only, with reference to the enclosed schematic drawings, in which.

DETAILED DESCRIPTION

Figure 1:
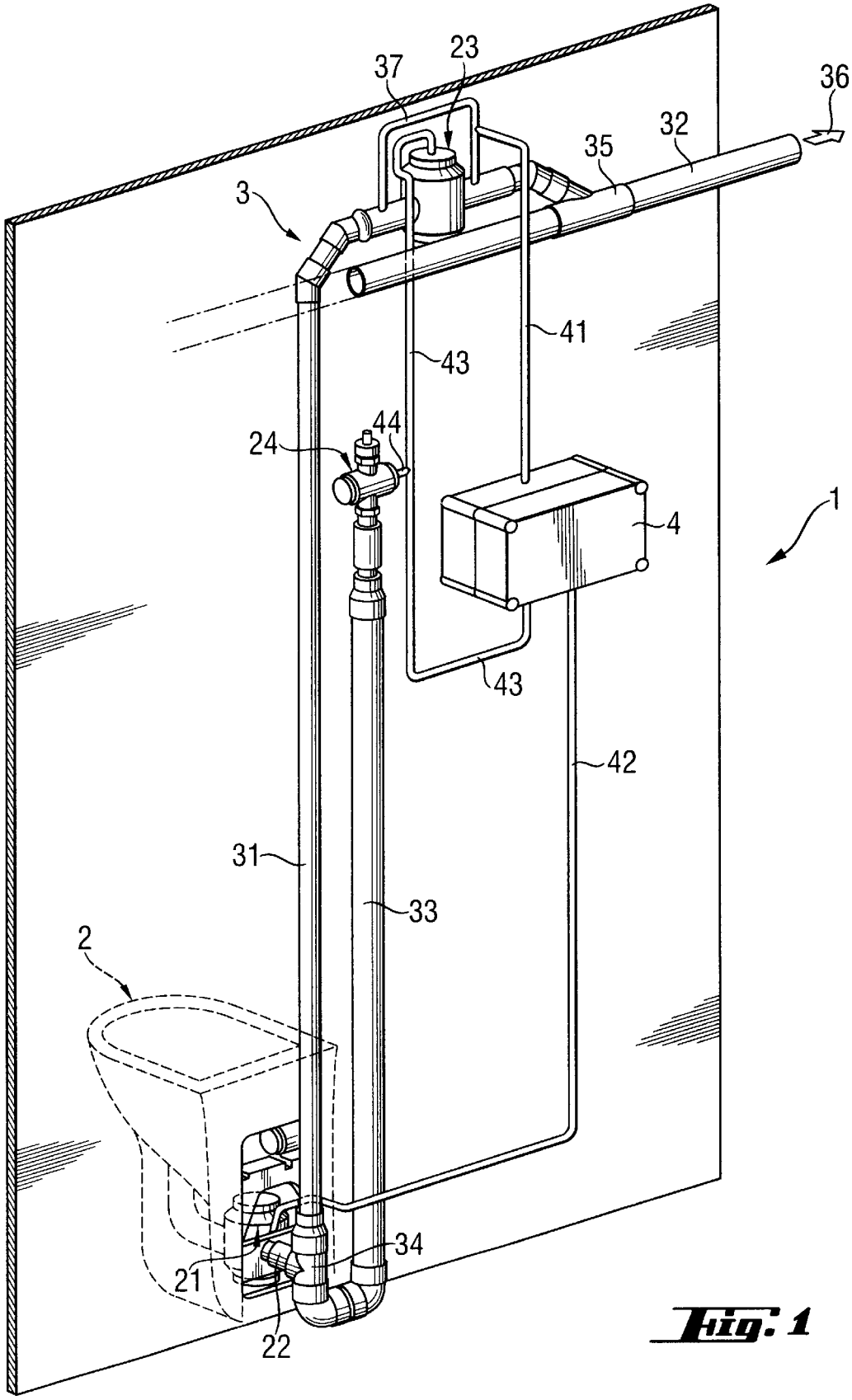
FIG. 1 is a perspective view of a first embodiment of a vacuum sewer system in accordance with the teachings of the present invention.

In FIG. 1 a part of a vacuum sewer system is generally indicated by reference numeral 1. The vacuum sewer system 1 comprises a source of sewage 2, in this embodiment a toilet unit (shown by broken lines). The source of sewage may also for example be a urinal, wash basin, shower unit, condensate receptacle, or the like. The vacuum sewer system further comprises sewer piping, generally indicated by reference numeral 3, and comprising a first sewer pipe 31 (commonly referred to as a riser or branch pipe), a second sewer pipe 32, (commonly referred to as a main line), and a third sewer pipe 33. The first sewer pipe 31 is connected to the third sewer pipe 33 by a first pipe junction 34 and to the second sewer pipe 32 by a second pipe junction 35.

The source of sewage is provided with a first sewer valve 21 having an outlet port 22 connected to the first pipe junction 34. Alternatively the outlet port 22 may be connected directly to the first sewer pipe 31 or the third sewer pipe 33 either directly or through a pipe junction. The first sewer pipe 31 is connected to the second sewer pipe 32 through a second sewer valve 23. Furthermore, the third sewer pipe 33, at an end opposite the first pipe junction 34 end (i.e. opposite the first sewer valve 21 end) of the third sewer pipe 33, is provided with a third valve means 24, particularly an aeration valve.

The vacuum sewer system 1 is provided with vacuum from a vacuum generation means, only generally indicated in the drawing by an arrow 36 in connection with the second sewer pipe 32. A constant vacuum connection is provided between the second sewer pipe 32 and the first sewer pipe 31 over the second sewer valve 23 through a pressure equalization means 37, in this embodiment a connection tube 37 connected to the second and first sewer pipes at opposite sides of the second sewer valve respectively. This arrangement also reduces the noise level at the pressure equalization stage, i.e. when the vacuum level is reinstated in the system after the drainage or flushing function.

The vacuum sewer system is also provided with a control center 4 which is in fluid communication with the vacuum generated by the vacuum generation means 36 through tubing, particularly a first tube 41 connected to the connection tube (pressure equalisation means) 37. The connection could as well be made to any other point of the vacuum sewer system providing vacuum in an appropriate manner.

Further the control center 4 is in fluid communication with the first sewer valve 21, the second sewer valve 23 and the third valve means 24, which in this embodiment are vacuum activated valves, in order to control the opening and closing of said valves. The fluid communication is established by further tubing, particularly a second tube 42, a third tube 43 and a fourth tube 44 (via the third tube 43) respectively.

In operation, vacuum is provided in the sewer piping 3 by way of the vacuum generating means 36, whereby vacuum is maintained in the second sewer pipe 32 and in the first and third sewer pipes 31 and 33 through the pressure equalization means 37, which provides a constant flow connection between the second sewer pipe 32 and the first sewer pipe 31, regardless of the state or position of the second sewer valve 23.

At an initial stage the first and second sewer valves 21 and 23 as well as the third valve means 24, the aeration valve, are closed. When sewage that has been deposited in the toilet unit 2 is to be drained, a flush function is activated through the control center 4 in a manner known per se. The control center 4 activates the vacuum connection through the first tube 41 and conveys the vacuum effect forward through the second tube 42 to the first sewer valve 21 in order to open the same. Due to the substantially normal atmospheric pressure prevailing in the toilet unit 2 bowl, the sewage is drained or flushed through the first sewer valve 21 in the form of discrete slugs into the first and third sewer pipes 31 and 33, which are under vacuum as indicated above. After the sewage slug and flush water have been drained into said sewer pipes 31 and 33, the pressure differential over the first sewer valve 21 is about 0 kPa (0 bar) and the first sewer valve 21 is closed. At this first transport phase the first and third sewer pipes 31 and 33 function as an intermediate receptacle for the sewage.

Subsequently, after a predetermined time, for example about 1 to 2 seconds, the control center 4 activates the vacuum connection through the first tube 41 and conveys the vacuum effect forward through the third tube 43 and the fourth tube 44 to the second sewer valve 23 and to the aeration valve 24 respectively, whereby said valves are opened. As a result, the sewage is subjected to a second transport phase, during which it is transported forward from the first and third sewer pipes 31 and 33 to the second sewer pipe 32 through the second sewer valve 23 due to the suction effect of the vacuum prevailing in the second sewer pipe 32. The function of the aeration valve 24 at the distal end of the third sewer pipe 33 is to provide additional atmospheric transport air into the third and first sewer pipes 33 and 31 to more effectively transport sewage during the second transport phase.

After the second transport phase, the second sewer valve 23 and the aeration valve 24 are closed and the desired vacuum level is reinstated in the vacuum piping 3 by way of the vacuum generation means 36, whereby the system is ready for a next drainage or flushing function.

The control center 4 is advantageously provided, for example, with solenoid valves for monitoring the connection and conveyance of vacuum through the appropriate tubes described above. Such solenoid valves are advantageously three-way valves, whereby in order to open the first sewer valve and correspondingly the second sewer valve and the aeration valve (third valve means), vacuum is allowed to communicate through a first and second port of the corresponding control center (solenoid) valve, and subsequently, in order to close said valves, firstly the vacuum communication is shut of and secondly a third port of the corresponding control center (solenoid) valve is opened to allow surrounding atmospheric air to communicate through the corresponding tubing 42,43 and 44 to close said valves. A corresponding arrangement can also be achieved by pneumatically operated valves.

In order to reduce the noise level in connection with the drainage or flushing function and the subsequent pressure equalisation stage, it has shown to be advantageous to provide a pipe section with an enlarged pipe diameter more or less directly after the outlet port 22 of the first sewer valve 21. This can be done by giving the first pipe junction 34 a larger diameter than the first sewer pipe 31 and the third sewer pipe 33. The diameter of the third sewer pipe can also be larger than the diameter of the first sewer pipe in order to provide for a larger volume intermediate receptacle, if so desired.

A desired volume of the intermediate receptacle for the sewage, i.e. the first and third sewer pipes 31, 33, can easily be provided by changing the lengths and/or the diameters, of said sewer pipes as described above. Different volumes may be applicable depending on in which connection the vacuum sewer system is used. Typical diameters involved in vacuum sewer systems are, for example, about 50 mm for the branch or first sewer pipe, whereby the enlarged diameter discussed above preferably could be about 63 mm.

The use of the aeration valve and the third sewer pipe can also be dependent of the type of sewage in question. If the source of sewage is, for example, a urinal or a wash basin, the sewage is "lighter", whereby additional transport air and additional volume of the intermediate receptacle may not be necessary. If the source of sewage is, for example a toilet unit, the sewage in question may be "heavier", whereby the extra transport air and the additional volume may be advantageous.

Figure 2:
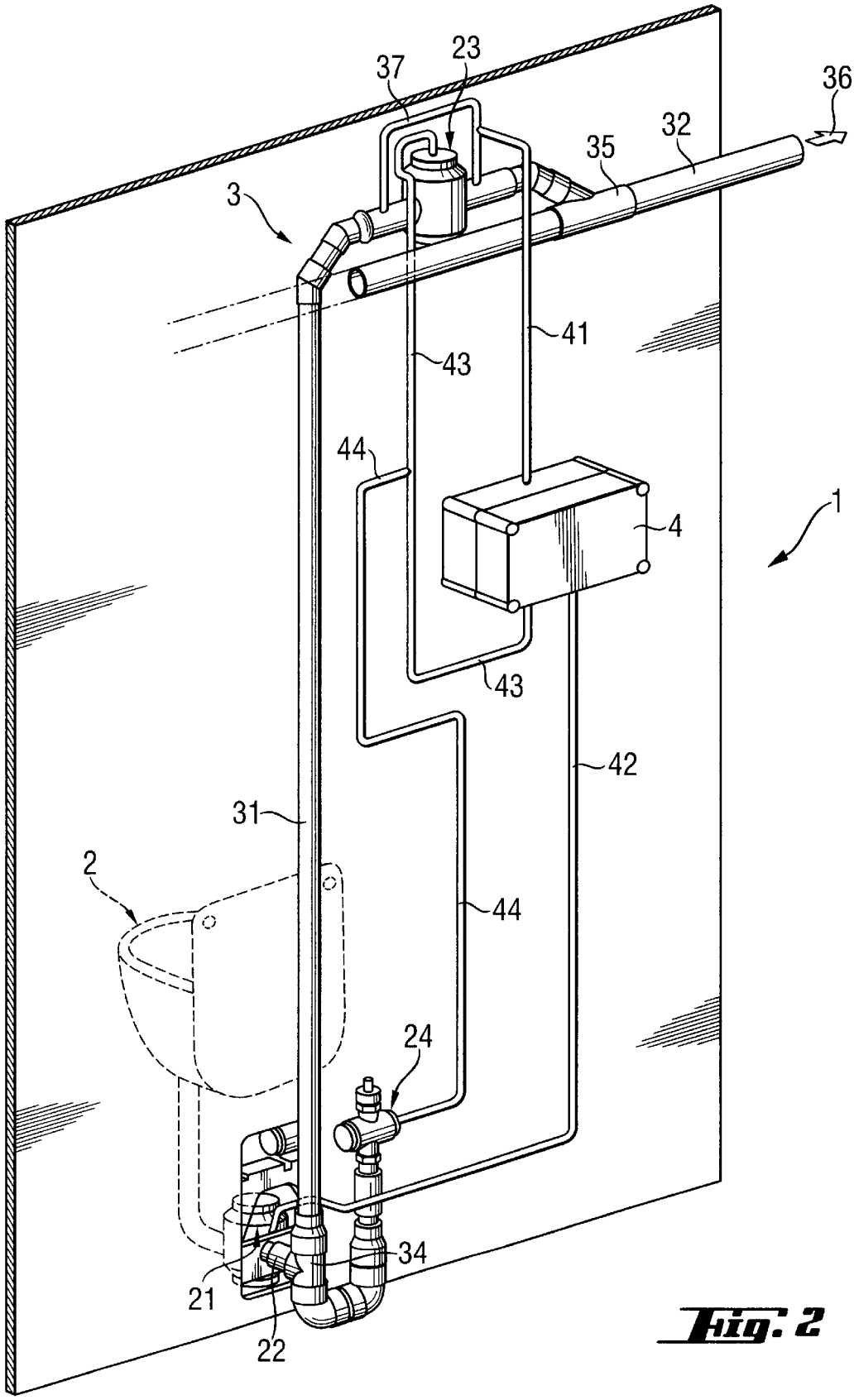
FIG. 2 is a perspective view of a second embodiment of a vacuum sewer system in accordance with the teachings of the present invention.

The second embodiment shown in FIG. 2 substantially corresponds to the embodiment shown in FIG. 1, and consequently the same reference numerals have been used for the same components.

The basic difference, however, is that the source of sewage 2 in this embodiment is shown as a urinal, i.e. providing a "lighter" form of sewage. The outlet port 22 of the first sewer valve 21 is connected to the first pipe junction 34, which has been provided with a larger diameter than said outlet port, and the first 30 sewer pipe 31 is connected to a first end of the first pipe junction 34 and the third valve means 24, i.e. the aeration valve, directly to a second end of the first pipe junction 34.

The operation of this embodiment corresponds to the operation of the first embodiment, with the exception of the arrangements in relation to the third sewer pipe.

The first sewer valve, the second sewer valve and the aeration valve have above been described as pneumatic, vacuum activated valves. However, one or more of the valves may as well be designed as mechanically or electrically operated valves, if so is preferred. Consequently, the control center can be adapted accordingly.

The drawings and the description related thereto are only intended for clarification of the idea of the invention. The invention may vary in further detail, e.g. relating to the enlarged outlet of the source of sewage, the volume of the intermediate receptacle, the provision of additional transport air, etc., within the scope of the ensuing claims.

What is claimed is:

1. A vacuum sewer system comprising:

a source of sewage;

sewer piping comprising a first sewer pipe and a second sewer pipe;

a first sewer valve disposed between the source of sewage and the first sewer pipe, the first sewer valve including an outlet port;

a second sewer valve disposed between the first sewer pipe and the second sewer pipe;

a vacuum generating means for providing vacuum in the sewer piping;

wherein the first sewer pipe provides an intermediate receptacle for the sewage.

2. The vacuum sewer system of claim 1, in which the first sewer pipe is provided with a third valve means at a first sewer valve end of the first sewer pipe.

3. The vacuum sewer system of claim 1, in which a pipe section with a larger diameter than the outlet port of the first sewer valve is arranged downstream of the first sewer valve.

4. The vacuum sewer system of claim 3, in which the pipe section with a larger diameter comprises a first pipe junction arranged between the outlet port of the first sewer valve and the first sewer pipe.

5. The vacuum sewer system of claim 4, in which the first pipe junction is provided with a third valve means.

6. The vacuum sewer system of claim 1, further comprising a third sewer pipe in fluid communication with the first sewer pipe at a first sewer valve end of the first sewer pipe.

7. The vacuum sewer system of claim 6, further comprising a first pipe junction arranged between the outlet port of the first sewer valve and the first sewer pipe, wherein the third sewer pipe is connected to the first pipe junction.

8. The vacuum sewer system of claim 6, in which the third sewer pipe is provided with a third valve means at an end opposite the first sewer valve end of the third sewer pipe.

9. The vacuum sewer system of claim 1, further comprising a pressure equalization means connecting the first sewer pipe and the second sewer pipe (32) at opposite sides of the second sewer valve, respectively.

10. The vacuum sewer system of claim 1, further comprising a control center operatively coupled to the first sewer valve and the second sewer valve.

11. The vacuum sewer system of claim 10, in which the first sewer valve and the second sewer valve comprise vacuum activated valves, and in which the control center is in fluid communication with the vacuum generated by the vacuum generation means and the first and second sewer valves.

12. The vacuum sewer system of claim 11, in which the control center is in fluid communication with the vacuum generated by the vacuum generation means through a pressure equalization means.

13. The vacuum sewer system of claim 11, in which tubing provides fluid communication between the control center and:

the vacuum generated by the vacuum generation means;

the first sewer valve; and the second sewer valve.

14. The vacuum sewer system of claim 10, in which the first sewer pipe is provided with a third valve means at a first sewer valve end of the first sewer pipe, and in which the control center is further operatively coupled to the third valve means.

* * * * *